US006550300B2

(12) United States Patent
Hoffmann et al.

(10) Patent No.: US 6,550,300 B2
(45) Date of Patent: Apr. 22, 2003

(54) APPARATUS FOR PRODUCING ANNULARLY CORRUGATED METAL TUBES

(75) Inventors: Ernst Hoffmann, Langenhagen (DE); Klaus-D. Jank, Barsinghausen (DE); Michael Meyer, Fuhrberg (DE); Robert Strohmeyer, Hannover (DE); Friedrich Harten, Hannover (DE)

(73) Assignee: Nexans, Paris (FR)

( * ) Notice: Subject to any disclaimer, the term of this patent is extended or adjusted under 35 U.S.C. 154(b) by 16 days.

(21) Appl. No.: 09/930,309

(22) Filed: Aug. 16, 2001

(65) Prior Publication Data

US 2002/0029598 A1 Mar. 14, 2002

(30) Foreign Application Priority Data

Aug. 17, 2000 (EP) ..... 00402299

(51) Int. Cl.[7] ..... B21D 3/00
(52) U.S. Cl. ..... 72/78; 72/370.19
(58) Field of Search ..... 72/77, 78, 370.19, 72/95, 100, 112, 126

(56) References Cited

U.S. PATENT DOCUMENTS 3,780,556 A 12/1973 Johnson
3,785,189 A * 1/1974 Asselborn et al. ..... 72/77
5,325,693 A * 7/1994 Hoffman et al. ..... 72/77
6,073,473 A 6/2000 Ziemek

FOREIGN PATENT DOCUMENTS

DE 458 947 4/1928
DE 2 106 177 11/1971

* cited by examiner

*Primary Examiner*—Ed Tolan
(74) *Attorney, Agent, or Firm*—Sughrue Mion, PLLC

(57) ABSTRACT

An apparatus for producing annularly corrugated metal tubes, particularly the outer conductor of coaxial high-frequency cables, using at least one pressure roller revolving around a plain tube. The corrugations are formed in the plain tube by the teeth of the pressure roller, which is rotatable about an axis at a 90° angle to the longitudinal axis of the tube, and the axis of rotation of the pressure roller, itself in a plane perpendicular to the longitudinal axis of the tube, revolves around the plain tube being fed to the pressure roller as the corrugations are produced. The plain tube in turn rotates the pressure roller by its feed. The tips of the teeth are substantially flat, the tube is tightly guided in a guide bushing (12) in front of and behind the engagement with the pressure roller (13), and the number of teeth (Z) ranges between 7 and 11, preferably between 8 and 10.

8 Claims, 4 Drawing Sheets

APPARATUS FOR PRODUCING ANNULARLY CORRUGATED METAL TUBES

This application is based on and claims the benefit of European Patent Application No. 00402299.2 filed Aug. 17, 2001, which is incorporated by reference herein.

BACKGROUND OF THE INVENTION

The invention relates to an apparatus for producing annularly corrugated metal tubes, particularly the outer conductor of coaxial high-frequency cables, by means of a pressure roller.

Published Swiss application CH-A-275 509 discloses an apparatus for producing corrugated tubes with a pressure roller revolving around the workpiece, in which the corrugation is formed by teeth of the pressure roller (i.e., a toothed wheel). The pressure roller is rotatable about an axis which is at a 90° angle to the longitudinal axis of the tube. Its axis of rotation, itself in a plane perpendicular to the longitudinal axis of the tube, revolves around the tube, which is being fed to the pressure roller, as the corrugation is being produced. The tube in turn rotates the pressure roller by its feed. This apparatus preferably includes three pressure rollers, which are offset by 120° and engage the tube. The tips of the teeth located along the outer circumferences of the pressure rollers are concave and adapted to the tube diameter so that the pressure rollers form a self-contained forming tool.

With this configuration of the pressure rollers, it is not possible to produce tubes with a deep corrugation. To achieve a smaller distance between corrugations and a greater corrugation depth, it is therefore proposed to further form the corrugated tube by axial pressing. This results in an uncontrollable irregular shape of the corrugation, however. Another substantial drawback is that, due to the concave tips of the teeth and the large number of teeth, extremely high torsion forces act on the tube, which makes continuous production of thin-walled metal tubes difficult, if not impossible.

SUMMARY OF THE INVENTION

It is an object of the present invention to produce metal tubes with an annular corrugation, where the ratio of corrugation depth $W_1$ to corrugation pitch $W_2$ is greater than 0.3. Corrugation depth $W_1$ is defined as the radial distance between a corrugation peak and the corrugation valley. Corrugation pitch $W_2$ is the distance between two corrugation peaks. This extremely deep corrugation is to be produced without any additional measures, i.e., during the corrugation process.

This object is attained by an apparatus for producing annularly corrugated metal tubes, by means of at least one pressure roller revolving around a plain tube, wherein the corrugations are formed in the plain tube by the teeth of the pressure roller which is rotatable about an axis at a 90° angle to the longitudinal tube axis, wherein the axis of rotation of the pressure roller, itself in a plane perpendicular to a longitudinal tube axis, revolves around the plain tube being fed to the pressure roller as the corrugations are produced, and wherein the plain tube in turn rotates the pressure roller by its feed. According to the invention, the tips of the teeth are flat, the tube is tightly guided in a guide bushing in front of and behind the engagement with the pressure roller, and the number of teeth ranges between 7 and 11, preferably between 8 and 10.

With the aid of the invention it has been possible to produce highly flexible metal tubes with deep corrugations in a single operation. Another essential advantage of the invention is that the corrugation, as viewed in the longitudinal direction of the metal tube, is uniform with respect to the corrugation depth and the corrugation pitch, so that the metal tubes are highly suitable as conductors of coaxial high-frequency cables and also as hollow conductors. There is no damage to the surface of the corrugated metal tube in the area of the corrugation valley or in the area of the corrugation sides.

Other advantageous features of the invention will be apparent from the detailed description below and the claims hereafter.

BRIEF DESCRIPTION OF THE DRAWINGS

The invention will now be described in greater detail, by way of example, with the aid of the embodiments depicted schematically in FIGS. 1 to 7, wherein:

FIGS. 3 and 4 are sectional views of an embodiment of a corrugation unit with two pressure rollers;

DETAILED DESCRIPTION OF THE INVENTION

Figure 1:
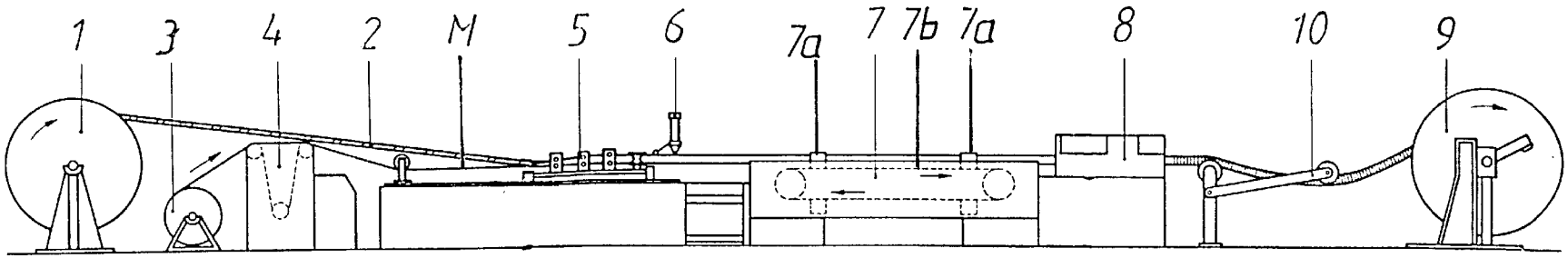
FIG. 1 is a side view of an apparatus for producing a coaxial high-frequency cable with an annularly corrugated outer conductor.
Figure 2:
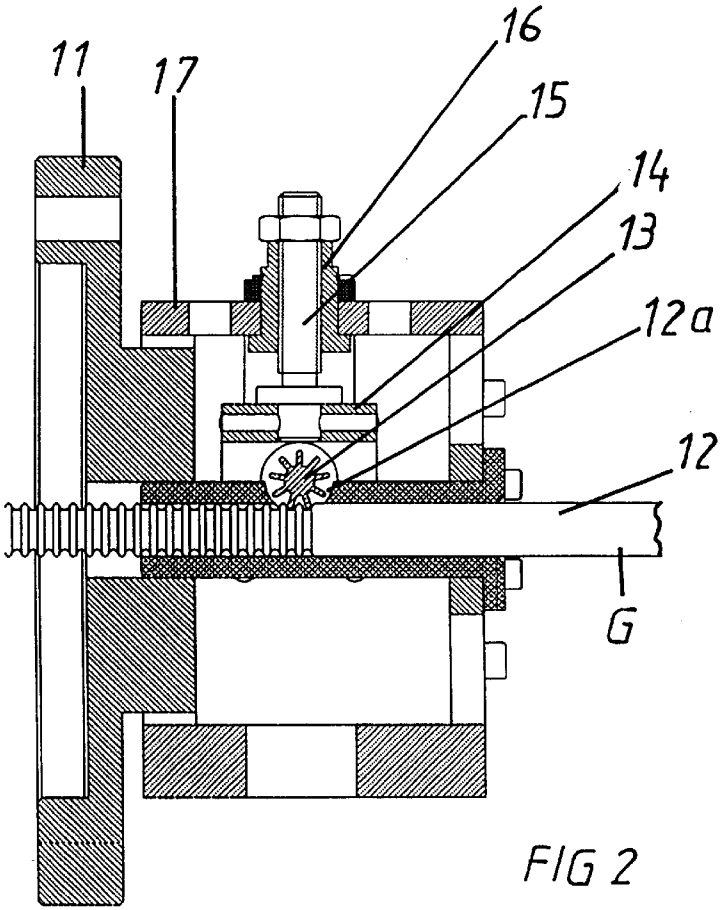
FIGS. 2 and 3 are sectional views of an embodiment of a corrugation unit with a single pressure roller.

FIG. 1 is a side view of an apparatus for producing a coaxial high-frequency cable with an annularly corrugated outer conductor.

The inner conductor 2, insulated with a foamed plastic layer, is continuously pulled off of a supply reel 1. A metal strip M, preferably a copper strip, is pulled from a strip coil 3 and cleaned in a cleaning unit 4. In a forming unit 5, the metal strip M is then shaped in several forming steps (not further described herein) into a slit tube surrounding the insulated inner conductor 2. The longitudinal slit is welded in a welding unit 6. The inside diameter of the welded tube is slightly larger than the outside diameter of the insulated inner conductor 2, so that the insulation layer is not affected by the welding heat. By means of a collet feed 7, the welded tube and insulated inner conductor 2 are transported through the unit in the direction of the arrows. The collet feed 7 has a plurality of clamping jaw pairs 7*a*, which grip the welded tube in pincer-like fashion. The clamping jaw pairs 7*a* are mounted to an endless chain 7*b*, which is driven by an electric motor in a manner not shown.

In corrugation unit 8 behind collet feed 7, as viewed in feed direction, the plain metal tube is transformed into a corrugated metal tube whose corrugation valleys fit closely against the insulation layer and compress it somewhat. This produces a coaxial high-frequency cable in which the gap between the insulation layer and the outer conductor is sealed.

The insulated inner conductor 2 provided with the corrugated metal tube is finally wound onto a cable drum 9. A dancer arrangement 10 controls the feed rate of cable drum 9.

Subsequently, an outer plastic sheath may be extruded onto the corrugated outer conductor in a manner not depicted.

The corrugation unit 8 will now be described in greater detail with the aid of FIGS. 2 to 5. A guide bushing 12 is fixed to a corrugation head 11 driven by a rotary drive. The inside diameter of the guide bushing 12 is approximately equal to the outside diameter of the welded plain tube G. The guide bushing 12 has a recess 12*a* into which extends the pressure roller 13 acting as a corrugation tool. Pressure roller 13 is freely rotatable on a bearing block 14. Bearing block 14 is radially adjustable by means of an adjusting spindle 15, which is guided in a threaded bushing 16. The threaded bushing 16 is rotatable in an end plate 17, which is fixedly connected to corrugation head 11. 18 identifies a counterweight, which ensures concentric running of the corrugation unit 8.

The depth of the corrugation to be produced in the plain tube G is adjusted by means of threaded spindle 15. In a rotary drive of corrugation head 11, the pressure roller 13 revolves around plain tube G and forms the corrugation. Since the plain tube G is being advanced by collet pull 7, pressure roller 13 is driven in such a way that it rotates about its axis of rotation. This causes the tooth of pressure roller 13, which is producing the last corrugation, to emerge from the corrugation valley and the next following tooth to engage with the advanced plain tube G. In this manner, pressure roller 13, revolving around the longitudinal tube axis and driven to rotate about its own axis of rotation, continuously produces a tube with an annular corrugation.

Figure 3:
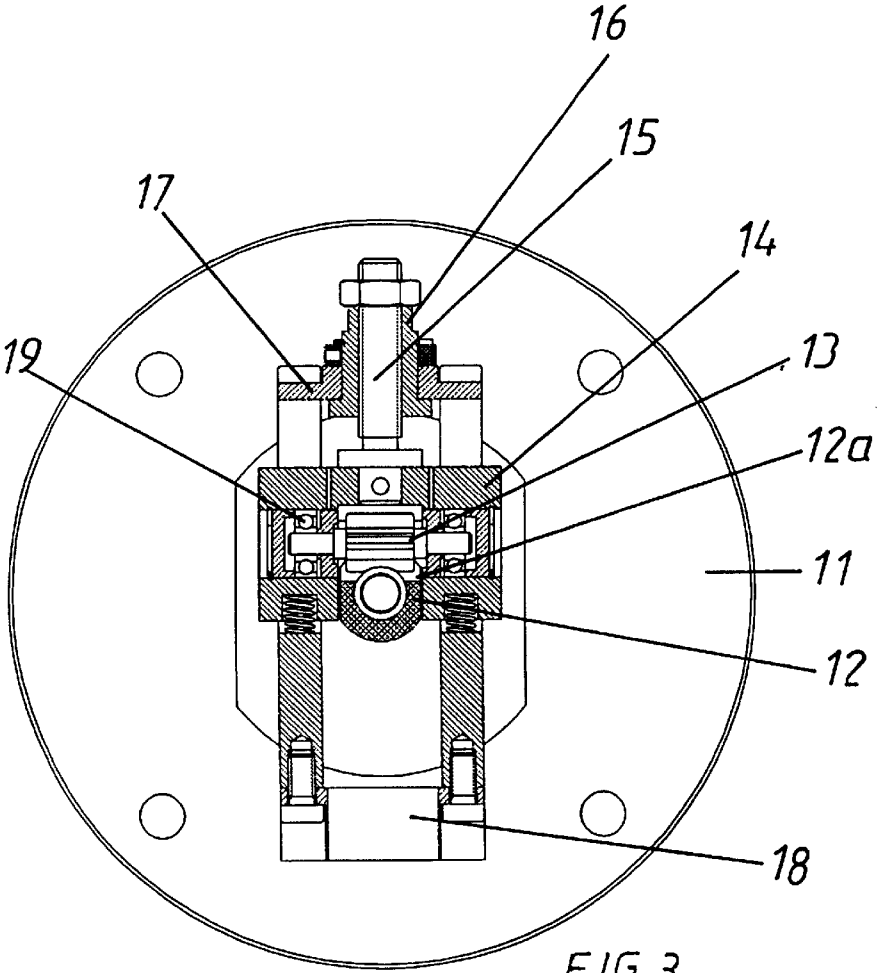

As illustrated in FIG. 3, pressure roller 13 is supported in outwardly sealed antifriction bearings 19 so that it can freely rotate.

Figure 4:
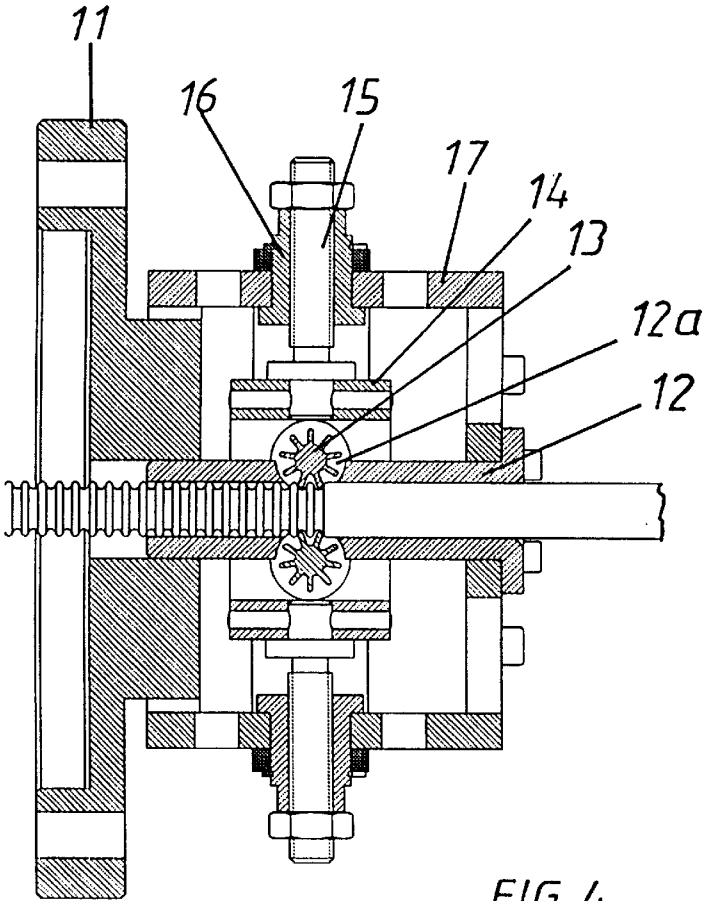
Figure 5:
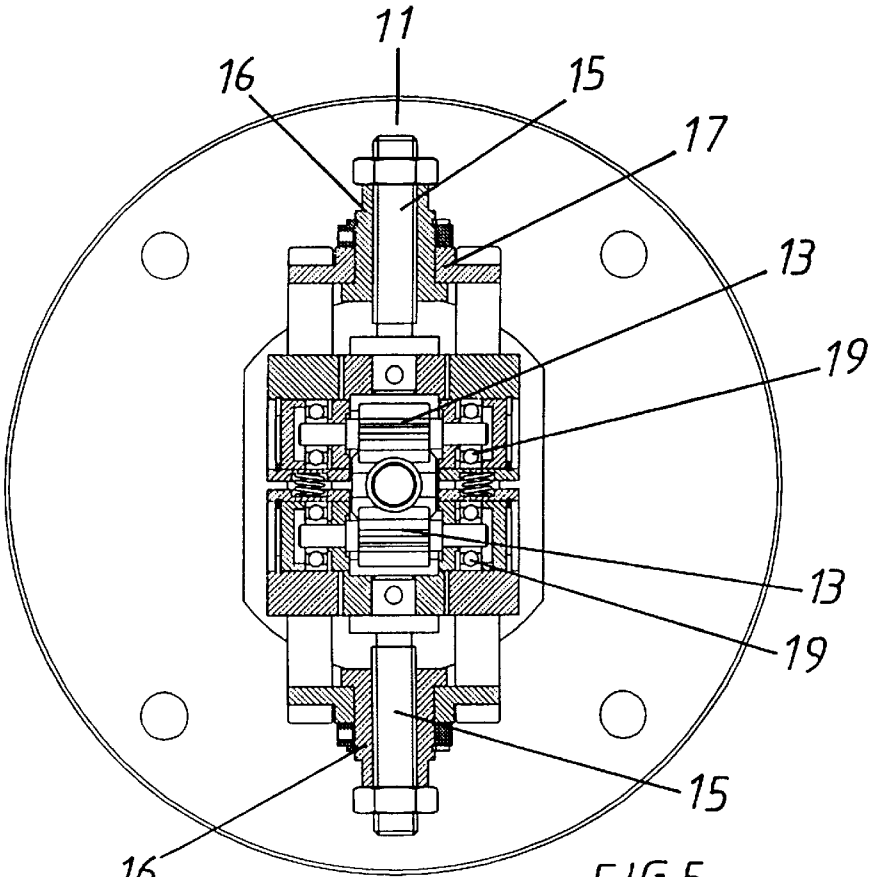

FIGS. 4 and 5 depict a corrugation unit with two pressure rollers 13 on opposite sides. This makes it possible to double the production rate at the same speed of rotation of corrugation head 11. Of course, three or more pressure rollers 13 may be used to obtain a multiple of the production rate.

Figure 6:
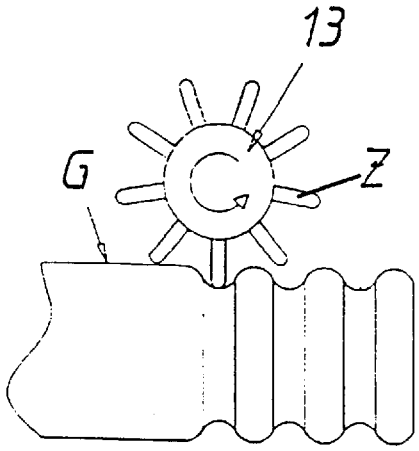
FIG. 6 illustrates the principle of the novel corrugation process.

FIG. 6 illustrates the principle of the novel corrugation process. Pressure roller 13 in relation to its axis of rotation approaches the center axis of plain tube G such that teeth Z sink into the wall of plain tube G to produce an annular corrugation as pressure roller 13 revolves around the center axis of plain tube G. Due to the feed of plain tube G, the pressure roller rotates in the direction indicated by the arrow, so that after one corrugation valley has been produced, the next tooth Z sinks into the wall of the plain tube.

According to the invention, the number of teeth Z is preferably limited to 7–11, since only this range makes it possible to obtain a ratio of corrugation depth to corrugation pitch of more than 0.3.

It is further advantageous if the tip diameter of the pressure roller is between 2.3 and 3.5 times the corrugation pitch or the distance between corrugations. Too small a tip diameter results in a mechanically unstable pressure roller 13, whereas too large a tip diameter does not make it possible to produce a deep corrugation. The tip diameter is defined as the diameter that covers teeth Z.

The tips of teeth Z are configured as shown in FIGS. 3 and 5. The width of teeth Z is greater than the diameter of the corrugated tube in the area of the corrugation valley. This makes it possible to obtain a particularly smooth surface in the area of the corrugation valley. For this same purpose, teeth Z are also hardened and polished, particularly in the area of the tip of the tooth. This reduces abrasive wear on the teeth Z as well as on the tube.

The sides of teeth Z extend parallel to one another, so that teeth Z, as they leave the corrugation valley, do not contact the corrugation sides and thus do not leave any undesirable indentations.

Figure 7:
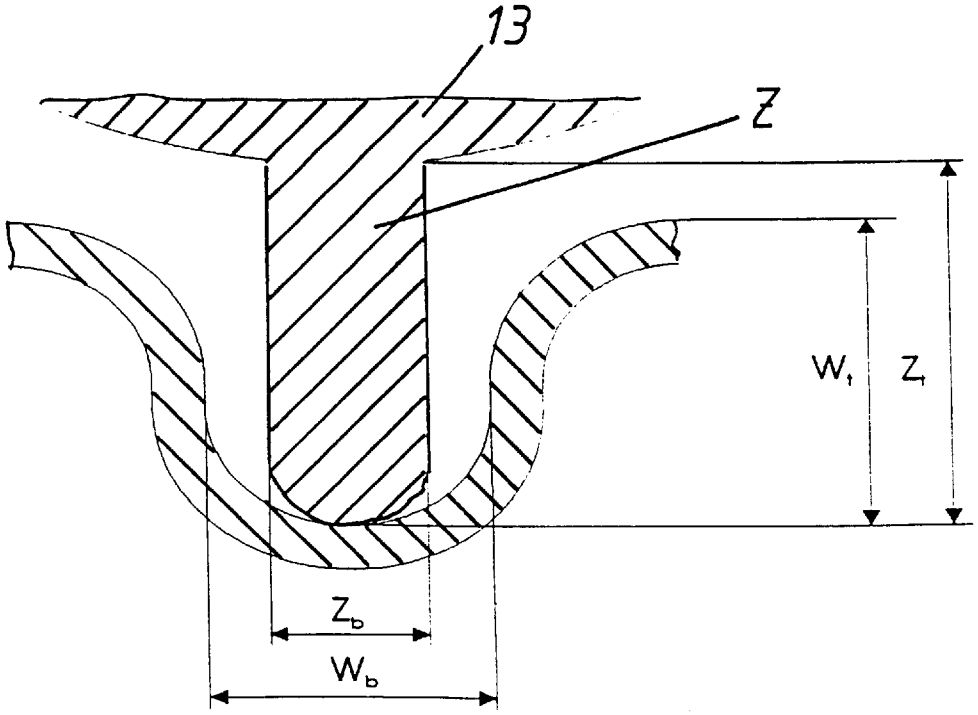
FIG. 7 is a drawing for illustrating the significance of the ratio of tooth height to corrugation depth.

To produce an optimal corrugation it is further advantageous if the height of the teeth is greater than the depth of the corrugation. This is shown, in particular, in FIG. 7. There, the ratio of tooth height $Z_1$ to corrugation depth $W_1$ is greater than 1.2.

What is claimed is:

1. An apparatus for producing annularly corrugated metal tubes, comprising:

at least one pressure roller revolving around a plain tube, wherein the corrugations are formed in the plain tube by teeth of the pressure roller, the pressure roller is rotatable about an axis at substantially a 90° angle with respect to a longitudinal axis of said tube, and the axis of rotation of said roller, itself in a plane perpendicular to said longitudinal tube axis, revolves around the plain tube being fed to the pressure roller as the corrugations are produced, with the plain tube in turn rotating the pressure roller by its feed, wherein the tips of said teeth are substantially flat, said tube is tightly guided in a guide bushing prior to and subsequent to engagement with the pressure roller, and the number of said teeth ranges between 7 and 11.

2. An apparatus as claimed in claim 1, wherein the width of the teeth is equal to or greater than a diameter of the tube in a corrugation valley between successive teeth.

3. An apparatus as claimed in claim 1, wherein the sides of said teeth extend nearly parallel to one another.

4. An apparatus as claimed in claim 1, wherein plural pressure rollers are uniformly distributed over the circumference of said plain tube and engage with the plain tube.

5. An apparatus as claimed in claim 1, wherein the teeth are hardened and/or polished at least in the area of a tooth tip.

6. An apparatus as claimed in claim 1, wherein hard metal parts are inserted in tips of said teeth.

7. An apparatus as claimed in claim 1, wherein a tip diameter of the pressure roller is between 2.3 and 3.5 times a corrugation pitch.

8. An apparatus as claimed in claim 1, wherein the number of teeth is between 8 and 10.

* * * * *